US009441439B2

(12) United States Patent
Allensworth

(10) Patent No.: US 9,441,439 B2
(45) Date of Patent: Sep. 13, 2016

(54) ROTARY ACTUATED CUTTER MODULE SYSTEM AND METHODOLOGY

(71) Applicant: Schlumberger Technology Corporation, Sugar Land, TX (US)

(72) Inventor: David Carter Allensworth, Pearland, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 508 days.

(21) Appl. No.: 13/961,063

(22) Filed: Aug. 7, 2013

(65) Prior Publication Data

US 2014/0041501 A1 Feb. 13, 2014

Related U.S. Application Data

(60) Provisional application No. 61/681,046, filed on Aug. 8, 2012.

(51) Int. Cl.

| | |
|---|---|
| ***E21B 33/06*** | (2006.01) |
| ***E21B 29/04*** | (2006.01) |
| ***E21B 29/08*** | (2006.01) |

(52) U.S. Cl.

CPC ..... *E21B 29/04* (2013.01); *E21B 29/08* (2013.01); *E21B 33/063* (2013.01); *Y10T 29/494* (2015.01); *Y10T 83/8749* (2015.04)

(58) Field of Classification Search

CPC ..... E21B 29/04; E21B 29/08

See application file for complete search history.

(56) References Cited

U.S. PATENT DOCUMENTS 969,755 A * 9/1910 Spang ..... E21B 29/04 166/54.6
978,577 A * 12/1910 Graham ..... E21B 29/04 166/54.6
4,160,478 A * 7/1979 Calhoun ..... E21B 29/04 166/319
4,422,059 A * 12/1983 Fuji ..... H03H 7/09 333/202
4,512,411 A 4/1985 Pringle
4,734,983 A * 4/1988 Brick ..... B23D 17/06 30/228
5,005,347 A * 4/1991 Kedem ..... A01D 46/253 56/328.1
5,284,209 A 2/1994 Godfrey
5,515,916 A * 5/1996 Haley ..... E21B 33/063 166/55
5,671,652 A * 9/1997 Weyer ..... F15B 15/06 92/107
2006/0254773 A1 11/2006 Schlegelmilch et al.
2008/0296027 A1 12/2008 Cruickshank et al.
2010/0051847 A1* 3/2010 Mailand ..... E21B 29/04 251/288
2013/0327536 A1* 12/2013 Alexander ..... E21B 29/08 166/373
2014/0290949 A1* 10/2014 Hall ..... E21B 33/063 166/298

* cited by examiner

*Primary Examiner* — William P Neuder
(74) *Attorney, Agent, or Firm* — Tuesday Kaasch

(57) ABSTRACT

A technique facilitates cutting of a conveyance or other member passing through a tubular system, such as a landing string and/or a subsea test tree. The technique utilizes a pair of cutter blades pivotably coupled together at a pivot which may be located adjacent a pair of cutting edges. The pair of cutter blades is located in a body which has a passage sized to enable movement of certain tools and conveyances therethrough. The pair of cutter blades is connected to a piston actuated mechanism which may be selectively actuated to move the cutting edges toward each other and across the passage extending through the body. When the cutter blades are in an open position, the tools and/or conveyance may be moved through the cutter body along the passage.

17 Claims, 7 Drawing Sheets

ROTARY ACTUATED CUTTER MODULE SYSTEM AND METHODOLOGY

CROSS-REFERENCE TO RELATED APPLICATION

The present document is based on and claims priority to U.S. Provisional Application Ser. No. 61/681,046, filed Aug. 8, 2012, incorporated herein by reference in its entirety.

BACKGROUND

Subsea test trees are used in a variety of subsea well applications. A subsea test tree enables well testing and well clean-up operations to be conducted from an offshore floating rig. The subsea test tree provides a fast acting mechanism to shut-in a well with two barriers while preventing discharge of landing string contents into a riser. The subsea test tree also enables disconnection of the landing string from the test string. In many applications, ball valves are used in the subsea test tree as a primary barrier along an internal access passage of the subsea test tree.

SUMMARY

In general, a methodology and system are provided for facilitating cutting in a tubular system, such as a landing string and/or subsea test tree. The technique utilizes a pair of cutter blades pivotably coupled together at a pivot which may be located adjacent a pair of cutting edges, e.g. curved cutting edges. The pair of cutter blades is located in a body which has a passage sized to enable movement of certain tools and conveyances therethrough. The pair of cutter blades is connected to a piston actuated mechanism which is selectively actuatable to move the cutting edges toward each other and across the passage of the body. However, when the cutter blades are in an open position, the tools and/or conveyance may be moved through the cutter body along the passage.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The present disclosure generally relates to a methodology and system for cutting. In some embodiments, the methodology and system utilize a cutter module designed for cutting a conveyance, such as a cable, a well tubing, e.g. coiled tubing, a wireline, a slick line, or other types of conveyances. In a variety of operations, including well related operations, a conveyance is used to deploy a tool or tools through various tubular structures. In subsea well applications, for example, the conveyance may be employed to move a tool through a landing string and/or a subsea test tree. The methodology and system provide a cutter module which may be incorporated into the landing string, subsea test tree, or other tubular structure to enable selective cutting or severing of the conveyance if, for example, the well is to be quickly sealed.

In some embodiments, the system comprises a cutter module having a pair of cutter blades pivotably coupled together at a pivot. The pivot may be located adjacent a pair of cutting edges, e.g. curved cutting edges, oriented toward each other along the cutter blades. The pair of cutter blades is located in a body, e.g. a housing, which has a passage sized to enable movement of certain tools and conveyances therethrough. The pair of cutter blades is connected to a piston actuated mechanism which is selectively actuatable to move the cutting edges toward each other and across the passage when the conveyance is to be severed. When the cutter blades are in an open position, the tools and/or conveyance may be moved through the cutter body along the passage. In some applications, the piston actuated mechanism comprises piston abutments which are coupled to curved pistons mounted in corresponding piston chambers. However, the piston actuated mechanism also may utilize other components such as a helical spine operated by a piston.

Figure 1:
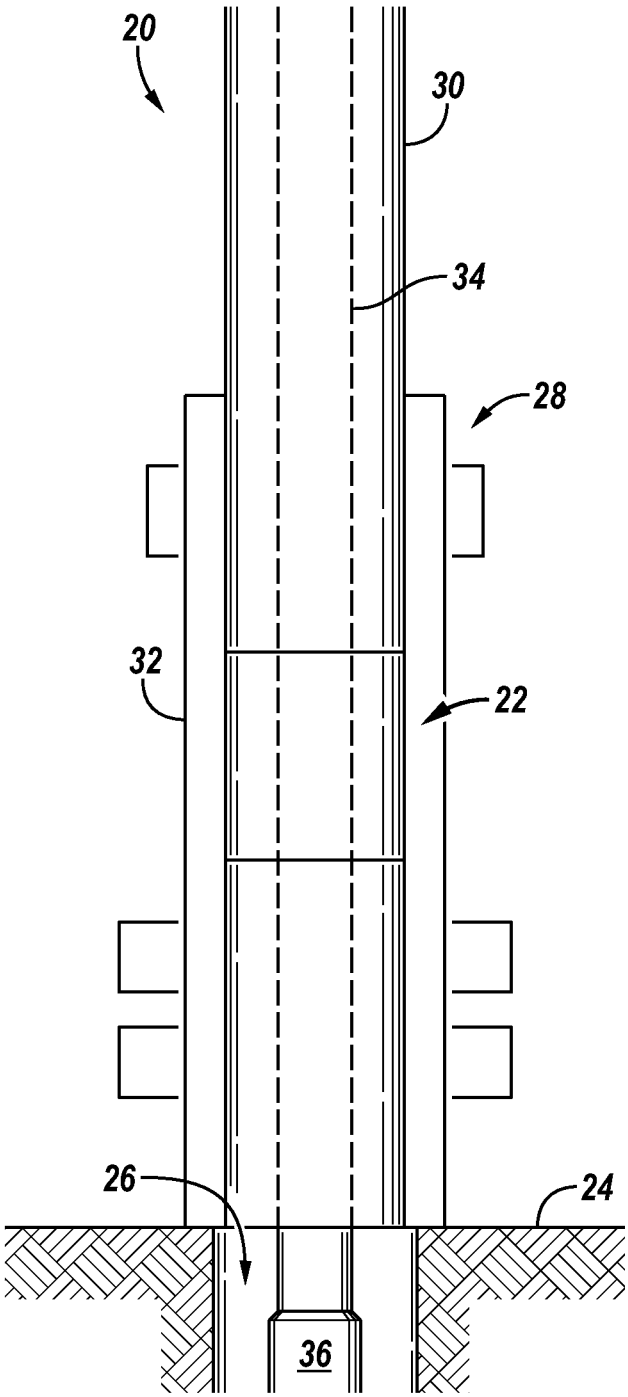
FIG. 1 is a schematic illustration of an example of a system, e.g. a well system, incorporating a cutter module, according to an embodiment of the disclosure.

Referring generally to FIG. 1, an embodiment of a system 20 is illustrated as comprising a cutter module 22. In this example, system 20 comprises a well system deployed at, for example, a subsea location 24 for use in cooperation with a well 26. However, system 20 also may comprise a variety of other types of tubular structures employed in non-well related applications which utilize cutter module 22 to facilitate selective severing of an internal component, e.g. conveyance.

In the example illustrated, cutter module 22 is mounted in a tubular well structure 28. By way of example, the tubular well structure 28 may comprise a landing string 30 and/or a subsea test tree 32. The cutter module 22 is designed to allow passage therethrough of a conveyance 34 which may be used to carry a variety of tools 36 to downhole locations or other locations.

Figure 2:
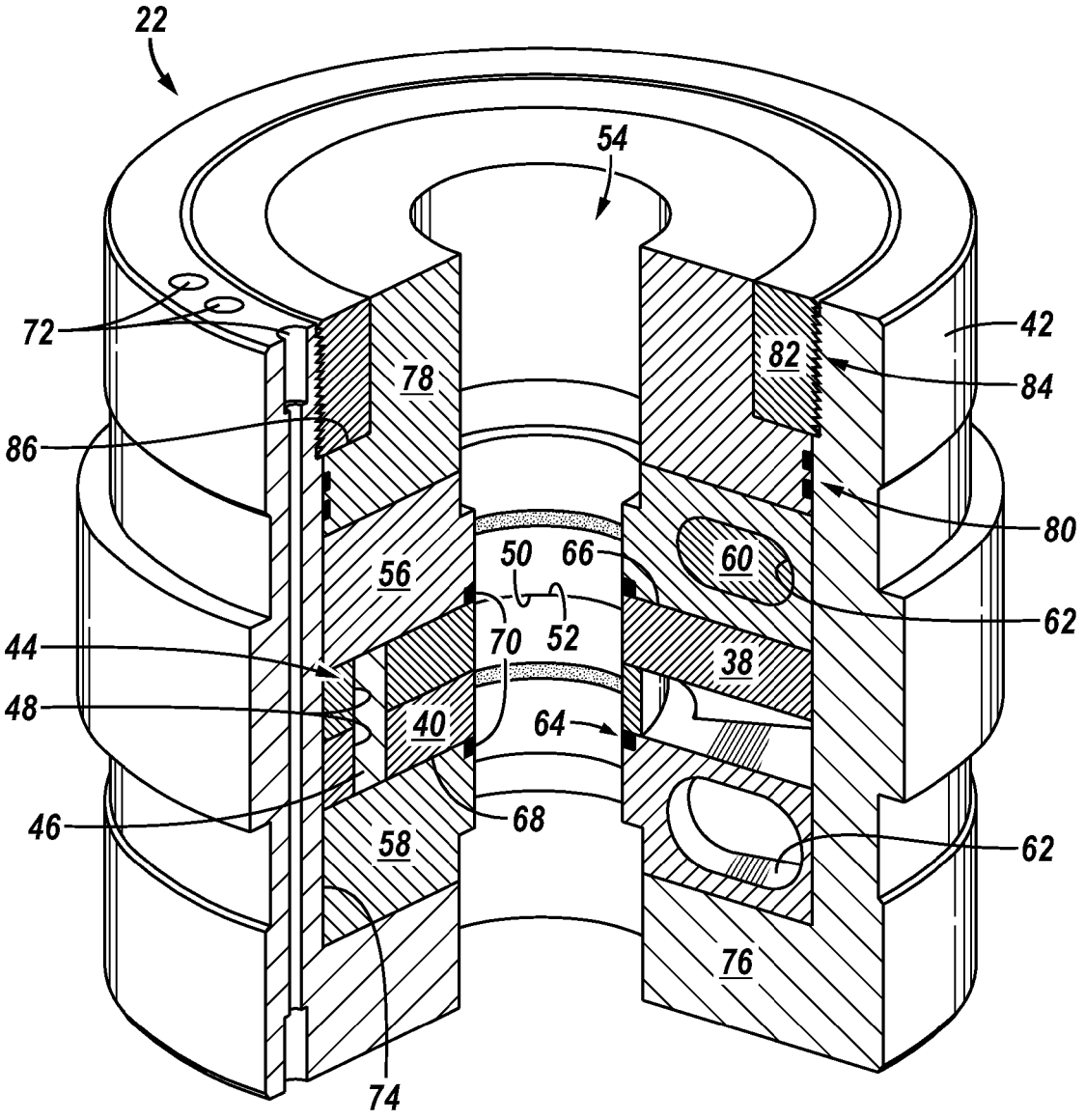
FIG. 2 is a partial cross-sectional view of an example of a cutter module having cutter blades in an open position, according to an embodiment of the disclosure.

Referring generally to FIG. 2, an embodiment of cutter module 22 is illustrated. In this embodiment, cutter module 22 comprises at least a pair of cutting or cutter blades in the form of a first cutter blade 38 and a second cutter blade 40. The cutter blades 38 and 40 are located within a surrounding body 42, e.g. a housing, and pivotably coupled to each other at a pivot 44. By way of example, pivot 44 may comprise a pivot pin 46 received in pivot apertures 48 of cutter blades 38 and 40. The cutter blades 38 and 40 have cutting edges 50 and 52, respectively. The cutting edges 50 and 52 may be in the form of curved cutting edges and in some embodiments the curved cutting edges 50, 52 may be circular. In some embodiments, however, the cutting edges 50, 52 may break through an outer surface of the respective cutter blades 38, 40, e.g. the cutting edges may form a partial circular or other open curvilinear shape. The curvature of cutting edges 50, 52 facilitates passage of tools 36 and conveyance 34 through a passage 54 of body 42 when the cutter blades 38, 40 are in an open position as illustrated in FIG. 2. The pivot 44 may be located adjacent the cutting edges 50 and 52 between the cutting edges 50, 52 and a laterally outer surface of cutter blades 38, 40 as illustrated.

In the example illustrated, the cutter blades 38, 40 are located axially between corresponding actuator housings 56, 58 which are designed to facilitate selective actuation of cutter blades 38, 40 between open and closed positions. As illustrated, each actuator housing 56, 58 contains an actuator piston 60, e.g. a curved actuator piston, slidably positioned in a corresponding, curved piston chamber 62. The curved actuator pistons 60 and corresponding curved piston chambers 62 within the actuator housings provide a space-efficient mechanism for actuating the cutter blades 38, 40. The actuator pistons 60 within actuator housings 56, 58 are coupled with cutter blades 38, 40, respectively.

When pressure is applied against the actuator pistons 60 via, for example, pressurized fluid introduced into curved piston chambers 62, the pistons 60 are driven along the corresponding curved piston chambers 62 in a manner which causes pivoting motion of cutter blades 38 and 40. During a cutting operation, for example, pressurized fluid is introduced to move pistons 60 in a direction which causes cutter blades 38, 40 to pivot at pivot 44 and to move the curved cutting edges 50, 52 toward each. Under sufficient pressure, the cutting edges 50, 52 can be forced through, for example, conveyance 34 to sever the conveyance and to ultimately close off passage 54.

Figure 3:
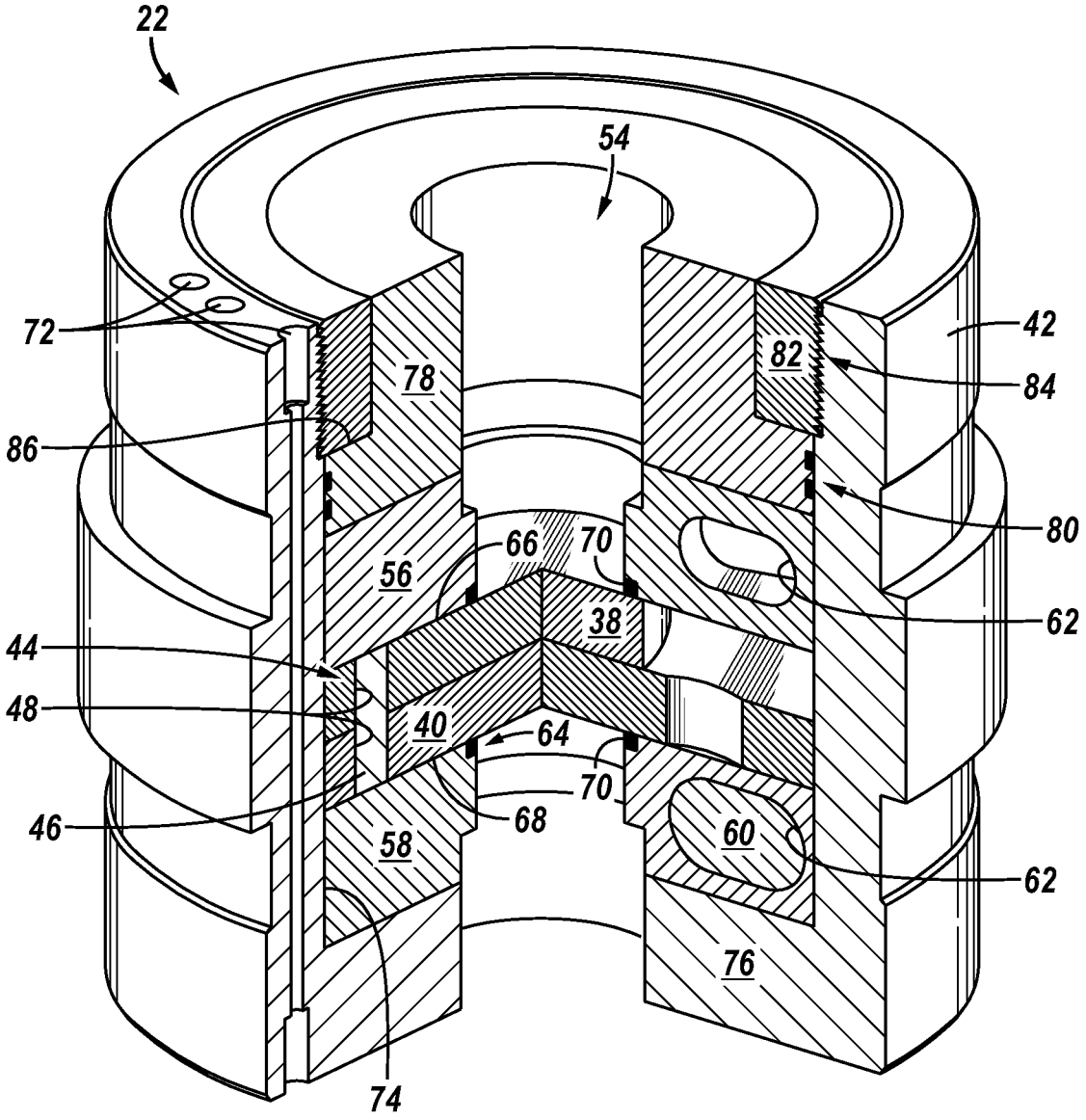
FIG. 3 is a partial cross-sectional view similar to that of FIG. 2 but showing the cutter blades in a closed position, according to an embodiment of the disclosure.

If passage 54 is closed and sealed, the sealing mechanism can be combined with cutter module 22 and/or placed at another location along passage 54. In some embodiments, a seal system 64 may be positioned to seal against side surfaces 66, 68 of cutter blades 38, 40, respectively, when the cutter blades 38, 40 are in a closed position, as illustrated in FIG. 3. By way of example, seal system 64 may comprise face seals 70. It should be noted that pressurized fluid for driving pistons 60 may be introduced into piston chambers 62 via a variety of appropriate ports 72 formed in body 42 and routed to the appropriate locations in piston chambers 62 for driving pistons 60 in a desired direction.

In the example illustrated, the cutter blades 38, 40 are positioned between the actuator housings 56, 58 which have a generally circular outside diameter designed for stacking in a cylindrical cavity 74 of body 42. The cylindrical cavity 74 is axially bounded on one end by an abutment member 76 of body 42. The cutter blades 38, 40 and the actuator housings 56, 58 may be stacked onto the abutment member 76. At an opposite end, the cutter blades 38, 40 and actuator housings 56, 58 are held within cavity 74 by a retention block 78. As illustrated, the retention block may be sealed with respect to the interior of body 42 by a seal or seals 80 and held in place by a retaining ring 82. By way of example, retaining ring 82 may be threadably engaged along an interior of body 42 via a threaded engagement region 84. The retaining ring 82 is threaded into engagement with a radially outlying lip 86 of retention block 78. However, a variety of other retention features, systems and techniques may be utilized to secure cutter blades 38, 40 and actuator housings 56, 58 within body 42. Additionally, the external profiles of the cutter blades 38, 40 and the actuator housings 56, 58 may vary to match or work within a variety of shapes and configurations of cavity 74.

Figure 4:
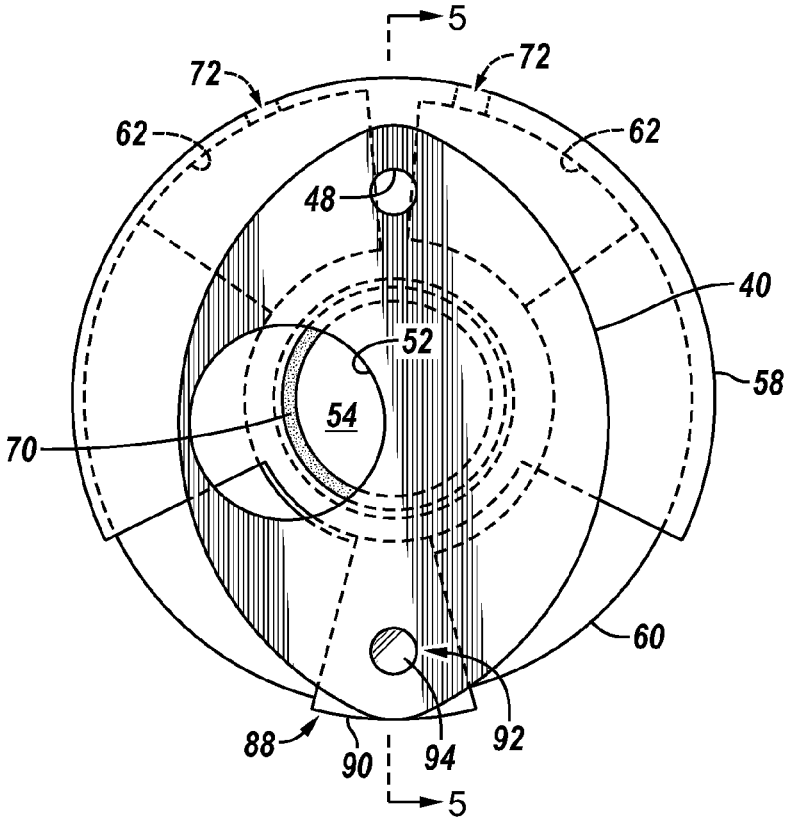
FIG. 4 is a top view of a portion of the cutter module showing a cutter blade mounted on an actuator housing, according to an embodiment of the disclosure.
Figure 5:
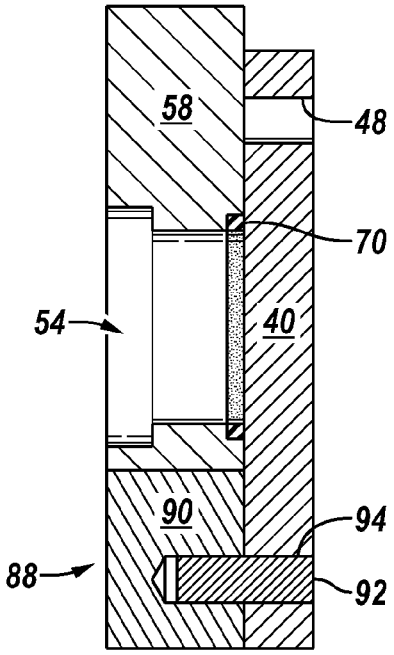
FIG. 5 is a cross-sectional view taken generally long line 5-5 of FIG. 4, according to an embodiment of the disclosure.
Figure 6:
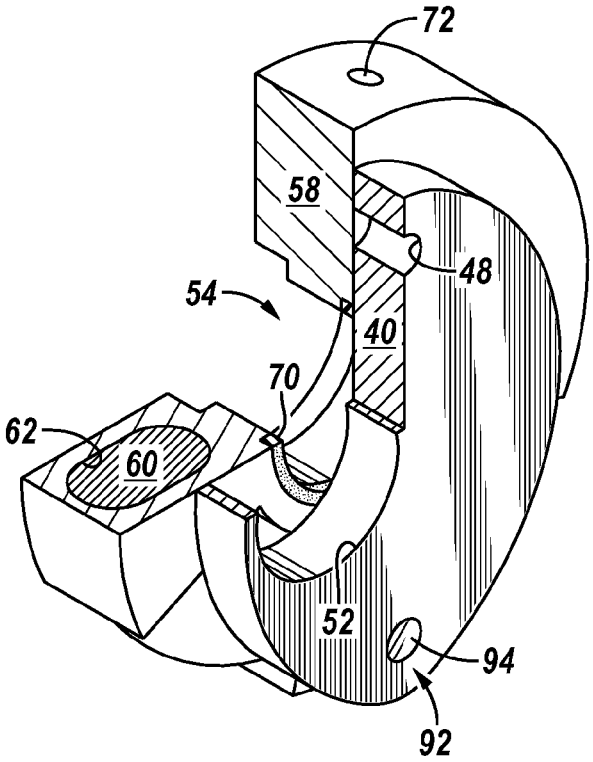
FIG. 6 is a partial cross-sectional view of the portion of the cutter module illustrated in FIG. 4, according to an embodiment of the disclosure.

Referring generally to FIGS. 4-6, an example of one of the cutter blades and corresponding actuator housing is illustrated in greater detail. In this example, cutter blade 40 and corresponding actuator housing 58 are illustrated to facilitate explanation, however cutter blade 38 and its corresponding actuator housing 56 operate in a similar manner. As illustrated, curved piston 60 is slidably received in a corresponding curved piston chamber 62. The curved piston chamber 62 may be divided into two sections for slidably receiving opposite ends of piston 60. In some embodiments, the piston 60 may be designed with a larger piston area on a given side to cause the cutter module 22 to default to a given position, e.g. a closed position, in the event of a failure. Piston 60 may be coupled to a piston actuated mechanism 88 which, in turn, is coupled to cutter blade 40. In the specific embodiment illustrated, piston actuated mechanism 88 comprises a piston abutment 90 pivotably coupled to cutter blade 40 via a piston abutment pivot 92. By way of example, piston abutment pivot 92 may be in the form of a pin 94 pivotably received by cutter blade 40, as illustrated in FIG. 5.

The piston abutment pivot 92 is designed to enable pivotable motion between piston abutment 90 and cutter blade 40 during transition of cutter blade 40 between open and closed positions. In FIGS. 4 and 6, the cutter blade 40 is illustrated as transitioned partially through passage 54 via movement of curved piston 60 along curved piston chamber 62. The curved piston 60 is moved under pressure supplied into the desired section of curved piston chamber 62 via the appropriate pressure port 72.

Figure 7:
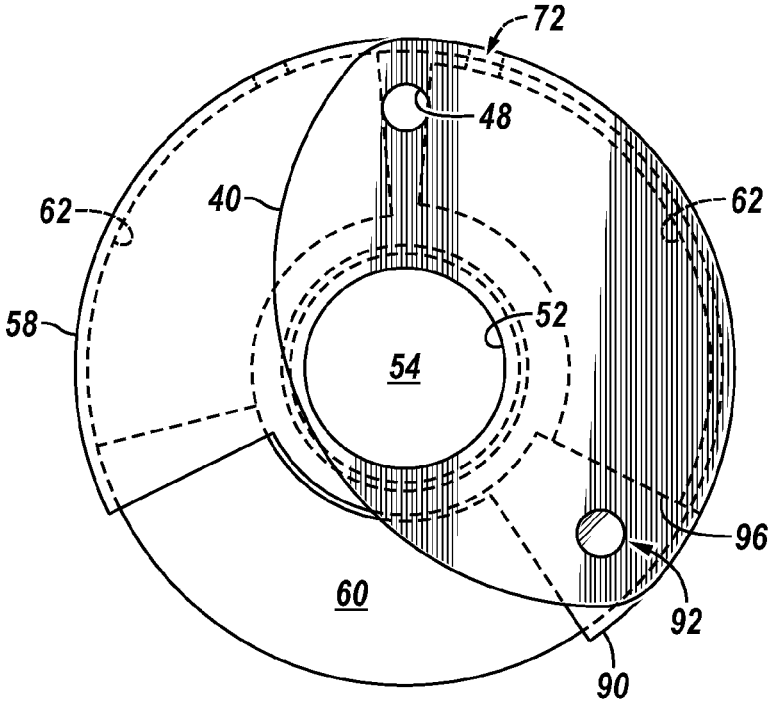
FIG. 7 is a top view of an example of a cutter blade mounted on an actuator housing with the cutter blade in an open position, according to an embodiment of the disclosure.
Figure 8:
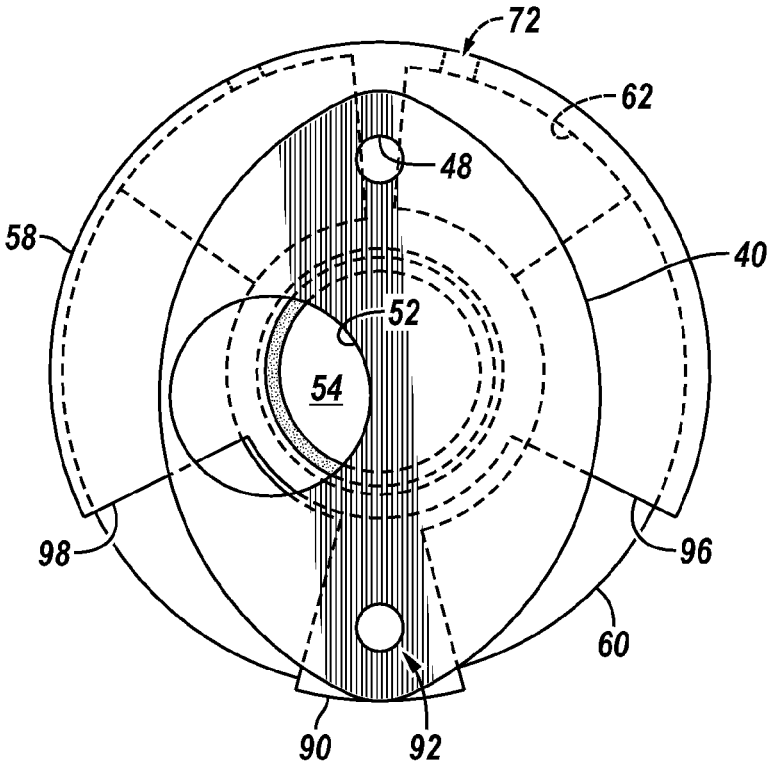
FIG. 8 is a top view similar to that of FIG. 7 but showing the cutter blade at a mid-stroke cutting position, according to an embodiment of the disclosure.
Figure 9:
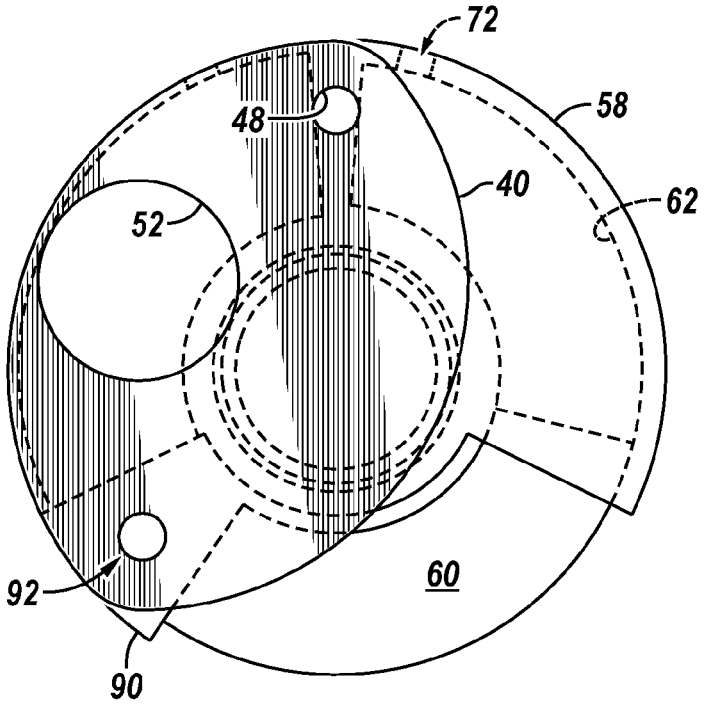
FIG. 9 is a top view similar to that of FIG. 7 but showing the cutter blade in a closed position, according to an embodiment of the disclosure.

An example of the transition of cutter blade 40 from an open position to a closed position via curved piston 60 is illustrated in FIGS. 7-9. It should be noted that a single cutter blade, e.g. cutter blade 40, can be used to perform the cutting operation against a corresponding cutting block. If a single cutter blade is used, a corresponding slot can be created to receive the pivot pin 46 in a manner which enables pivoting of the single cutter blade. However, the cutter blade 40 also may be combined with cutter blade 38 (as illustrated in FIGS. 2 and 3) to cooperate in cutting through passage 54 so as to sever, for example, conveyance 34. When two cutter blades 38, 40 are employed, the cutting stroke may be designed to utilize both cutter blades 38, 40 by moving them in opposite directions with respect to each other such that adjacent curved cutting edges 50, 52 are able to close through passage 54. This allows the cutting edges 50, 52 to sever the conveyance 34 or another member located within passage 54. Regardless, the actuation of individual or both cutter blades 38, 40 through passage 54 may be accomplished as illustrated in FIGS. 7-9.

In the open position, piston 60 has been moved along curved piston chamber 62 until piston abutment 90 reaches an abutment surface 96 of actuator housing 58. When piston abutment 90 is moved against abutment surface 96, cutting edge 52 of cutter blade 40 is positioned laterally in a non-interfering position with respect to passage 54, as illustrated in FIG. 7. This open position enables movement of, for example, tools 36 and conveyance 34 through passage 54 of cutter module 22. When pressurized fluid is directed through port 72 and into curved piston chamber 62 on a side closest to abutment surface 96, piston 60 is driven in a direction which begins to move cutting edge 52 through passage 54, as illustrated in FIG. 8. In the two cutter blade system, pivot 44 allows the cutter blades 38, 40 to pivot with respect to each other and to move their cutting edges 50, 52 past each other in a cutting motion. The piston abutment pivots 92 allow pivoting motion between each cutter blade 38, 40 and the corresponding piston abutment 90.

To move the cutter blade or blades 38, 40 to the closed position, pressurized fluid is continually fed through the same port 72 until piston 60 is fully shifted along curved piston chamber 62. As illustrated in FIG. 9, the actuator housing 58 may be designed with a second abutment surface 98 which is contacted by piston abutment 90 when the cutter blade is in the closed position. The closed position involves movement of each or both cutter blades so as to sever conveyance 34 (or other component in passage 54) and to close off passage 54. In some embodiments, each cutter blade 38, 40 is designed with sufficient side surface area to fully seal against face seal 70 when in the closed position. However, other sealing devices may be used in combination with cutter module 22 to seal off flow through passage 54. In the examples illustrated, cutting edge 52 (and cutting edge 50) is curved in a fully circular form. However, the cutting edges 50, 52 may have a variety of other shapes or forms depending on the parameters of a given cutter module and cutting application.

Figure 10:
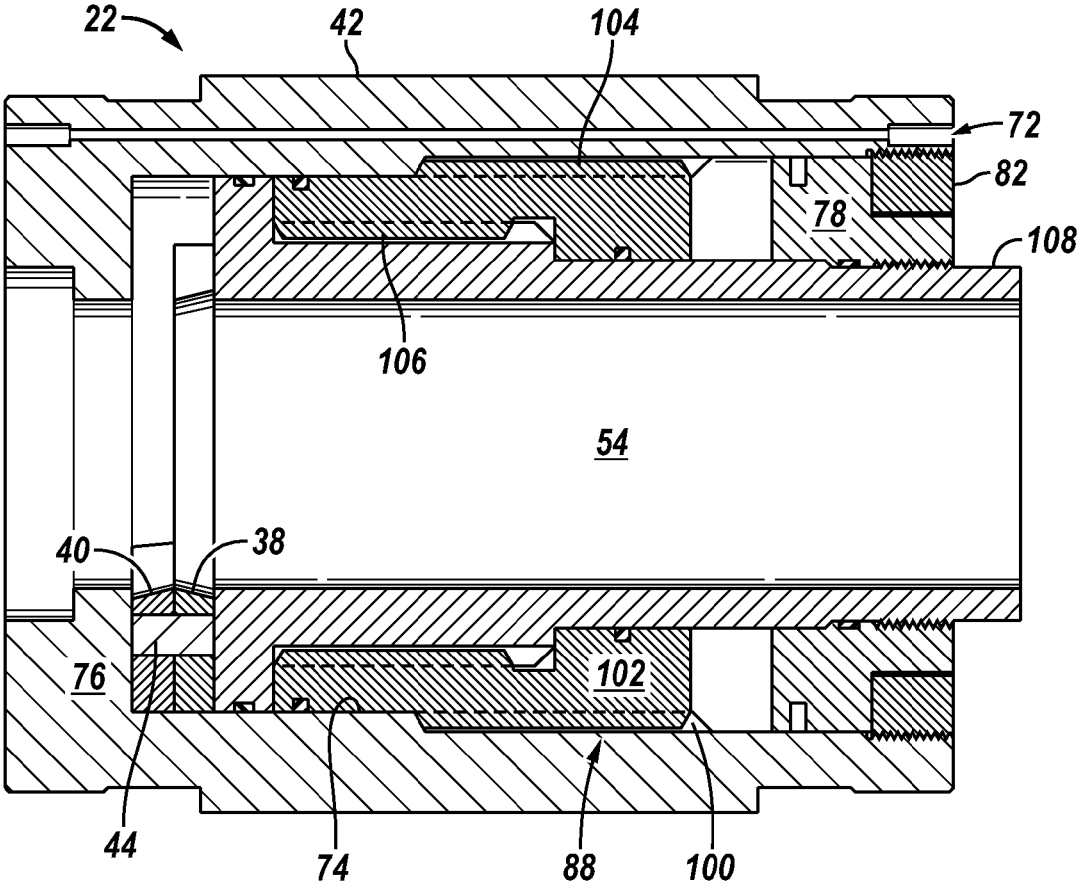
FIG. 10 is a cross-sectional view of another example of the cutter module, according to another embodiment of the disclosure.

Referring generally to FIG. 10, another embodiment of cutter module 22 is illustrated. In this embodiment, cutter module 22 utilizes piston actuated mechanism 88 in the form of a helical spline 100 actuated by a piston 102. By way of example, helical spline 100 comprises a right-hand helical spline member 104 coupled between piston 102 and body 42. In this example, the helical spline 100 also comprises a left-hand helical spline member 106 coupled between right-hand helical spline member 104 and a mandrel 108. The mandrel 108 and the body 42 may be coupled to individual cutter blades 38, 40 to cause the relative motion between cutter blades 38, 40 during the transition between open and closed positions. In this example, piston 102 may be actuated in an axial direction via pressurized fluid supplied through appropriate ports 72. The axial movement of piston 108 causes relative rotation between mandrel 108 and body 42 which, in turn, causes relative movement between cutter blades 38 and 40 so as to enable severing of, for example, conveyance 34 extending through passage 54.

As described herein, the cutter module 22 may be used in a variety of systems 20. In several types of well applications, the cutter module 22 may be combined with landing strings and/or subsea test trees to provide a compact module able to selectively sever conveyances used to deploy tools downhole. However, the cutter module 22 also may be utilized in surface applications and in cooperation with a variety of tubular structures through which severable members, e.g. conveyances, are deployed for a given operation.

The cutter module 22 also may comprise additional and/or other types of components to facilitate the cutting operation within a compact body, e.g. housing. The cutter blades, cutting edges, actuator pistons, and actuator piston chambers may be designed in a variety of forms and configurations from suitable materials for a given environment and operation. The actuator pistons also may be actuated via pressure applied according to various techniques. For example, hydraulic fluid supplied down through a wellbore tubing string may be selectively controlled and introduced into the hydraulic piston chambers to move the actuator pistons in a desired direction to cause pivotable motion of the cutter blades.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A method for cutting, comprising:

providing a first curved cutting blade and a second curved cutting blade;

mounting the first and second curved cutting blades in a body;

mounting the body into a subsea test tree of a well system;

pivotably coupling the first curved cutting blade with the second curved cutting blade such that an opening is formed between a curved cutting edge of the first curved cutting blade and a corresponding curved cutting edge of the second curved cutting blade when the first and second curved cutting blades are pivoted to an open position;

coupling the first and second curved cutting blades to a first curved actuator piston and a second curved actuator piston, respectively, mounted in the body.

2. The method as recited in claim 1, further comprising applying pressure to the first curved actuator piston and the second curved actuator piston to pivot the first and second curved cutting blades to a closed position.

3. The method as recited in claim 1, further comprising mounting the body into a landing string of a well system.

4. The method as recited in claim 2, wherein applying pressure comprises applying hydraulic pressure in a first curved chamber in which the first curved actuation piston is slidably received.

5. The method as recited in claim 4, wherein applying pressure further comprises applying hydraulic pressure in a second curved chamber in which the second curved actuation piston is slidably received.

6. The method as recited in claim 1, further comprising forming the first curved cutting edge as a circular cutting edge.

7. The method as recited in claim 6, further comprising forming the second curved cutting edge as a circular cutting edge.

8. The method as recited in claim 1, further comprising positioning a seal system to seal against the first and second curved cutting blades.

9. The method as recited in claim 1, further comprising routing a conveyance through the opening and actuating the first and second cutter blades to a closed position to sever the conveyance.

10. A system for cutting, comprising:

a cutter body having a through passage and at least one curved chamber in which a pair of curved actuator pistons is slidably mounted; and a pair of cutter blades, each cutter blade being coupled to a corresponding curved actuator piston of the pair of curved actuator pistons, each cutter blade having a cutting edge movable between an open position, allowing movement along the through passage, and a closed position via the corresponding curved actuator pistons.

11. The system as recited in claim 10, further comprising a seal system which seals off the through passage when the pair of cutter blades is in the closed position.

12. The system as recited in claim 10, wherein the cutter blades of the pair of cutter blades are pivotably coupled to each other.

13. The system as recited in claim 10, wherein the at least one curved chamber comprises a pair of curved pressure chamber sections with pressure ports for receiving pressurized fluid to drive the pair of curved actuator pistons.

14. The system as recited in claim 10, further comprising a landing string into which the cutter body is mounted.

15. The system as recited in claim 10, further comprising a subsea test tree into which the cutter body is mounted.

16. The system as recited in claim 10, wherein the cutting edge of each cutter blade is curved.

17. A method, comprising:

pivotably coupling a pair of cutter blades at a pivot located adjacent a pair of cutting edges of the pair of cutter blades;

locating the pair of cutter blades within a body to enable a cutting action across a passage extending through the body;

connecting the pair of cutter blades, at ends opposite the pivot, to a helical spline operated by a piston or to a pair of piston abutments operated by a pair of curved pistons to move the cutting edges toward each other and across the passage; and moving a conveyance through the passage while the pair of cutter blades is in an open position.

* * * * *